US010913269B2

(12) United States Patent
Kato et al.

(10) Patent No.: US 10,913,269 B2
(45) **Date of Patent: *Feb. 9, 2021**

(54) LIQUID DISCHARGE HEAD SUBSTRATE AND LIQUID DISCHARGE HEAD

(71) Applicant: CANON KABUSHIKI KAISHA, Tokyo (JP)

(72) Inventors: Maki Kato, Fuchu (JP); Yoshinori Misumi, Tokyo (JP); Yuzuru Ishida, Yokohama (JP); Tsubasa Funabashi, Yokohama (JP); Takahiro Matsui, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/271,176

(22) Filed: Feb. 8, 2019

(65) Prior Publication Data

US 2019/0255848 A1 Aug. 22, 2019

(30) Foreign Application Priority Data

Feb. 22, 2018 (JP) ..... 2018-030192
Jan. 11, 2019 (JP) ..... 2019-003805

(51) Int. Cl.
*B41J 2/14* (2006.01)

(52) U.S. Cl.
CPC ..... *B41J 2/14072* (2013.01); *B41J 2/14088* (2013.01); *B41J 2/14129* (2013.01); *B41J 2202/12* (2013.01); *B41J 2202/20* (2013.01)

(58) Field of Classification Search
CPC ..... B41J 2/14; B41J 2/14072; B41J 2/14129; H01H 85/0241
See application file for complete search history.

(56) References Cited

U.S. PATENT DOCUMENTS

| | | | |
|---|---|---|---|
| 6,512,284 B2 | 1/2003 | Schulte | |
| 2004/0085405 A1 | 5/2004 | Baek | |
| 2005/0275695 A1 | 12/2005 | Murata | |
| 2014/0184703 A1* | 7/2014 | Hatsui et al. | B41J 2/14129 |
| 2016/0325544 A1 | 11/2016 | Takahashi et al. | |

(Continued)

FOREIGN PATENT DOCUMENTS

| | | |
|---|---|---|
| CN | 1704243 A | 12/2005 |
| CN | 1853934 A | 11/2006 |

(Continued)

*Primary Examiner* — Juanita D Jackson
(74) *Attorney, Agent, or Firm* — Canon U.S.A., Inc. IP Division

(57) ABSTRACT

The liquid discharge head substrate includes a first covering portion that covers the first heat generation element and that has conductivity, a second covering portion that covers the second heat generation element and that has conductivity, an insulative layer disposed between the first heat generation element and the first covering portion and between the second heat generation element and the second covering portion, a fuse portion provided on the substrate on a side on which the first covering portion is provided, common wiring for electrically coupling the first covering portion and the second covering portion, the common wiring coupled with the first covering portion via the fuse portion, and a cover layer including at least silicon and carbon and covering the fuse portion.

17 Claims, 8 Drawing Sheets

(56) References Cited

U.S. PATENT DOCUMENTS

| | | | | |
|---|---|---|---|---|
| 2017/0305168 | A1 | 10/2017 | Coventry | |
| 2019/0255844 | A1* | 8/2019 | Funabashi et al. | B41J 2/14 |
| 2019/0255850 | A1* | 8/2019 | Kato et al. | B41J 2/14129 |

FOREIGN PATENT DOCUMENTS

| | | | |
|---|---|---|---|
| CN | 1942323 | A | 4/2007 |
| CN | 103287103 | A | 9/2013 |
| CN | 107073956 | A | 8/2017 |
| JP | 2014-124920 | A | 7/2014 |
| JP | 2015-093381 | A | 5/2015 |

* cited by examiner

LIQUID DISCHARGE HEAD SUBSTRATE AND LIQUID DISCHARGE HEAD

BACKGROUND

Field

The present disclosure relates to a liquid discharge head substrate used in a liquid discharge head that discharges a liquid and to a liquid discharge head.

Description of the Related Art

At present, many liquid discharge apparatuses are employed in which a liquid discharge head is mounted. The liquid discharge head discharges a droplet from a discharge opening using bubble generating energy created by film boiling a liquid by applying electricity to a heat generation element and heating the liquid inside a liquid chamber. When the printing is performed in such a liquid discharge apparatus, there are cases in which a physical effect, such as an impact caused by cavitation that occurs when liquid bubbling, shrinkage, and debubbling take place in an area on a heat generation element, is exerted in the area on the heat generation element. Furthermore, when the liquid is discharged, since the heat generation element becomes high in temperature, there are cases in which a chemical action, such as a component of the liquid becoming decomposed by heat, becoming attached to a surface of the heat generation element, and solidifying and accumulating on the surface of the heat generation element, occur on a region of the heat generation element. In order to protect the heat generation element from such a physical effect or a chemical action, a protective layer serving as a covering portion that covers the heat generation element is disposed on the heat generation element.

Normally, the protective layer is disposed at a position that comes in contact with the liquid. Accordingly, when electricity flows through the protective layer, an electrochemical reaction may occur between the protective layer and the liquid, and the function of the protective layer may be hindered. Accordingly, an insulative layer is provided between the heat generation element and the protective layer so that a portion of the electricity supplied to the heat generation element does not flow to the protective layer.

However, there is a possibility of the function of the insulative layer becoming lost (a chance failure) due to some kind of cause and a connection in which electricity directly flows from the heat generation element or the wiring to the protective layer may be established. When a portion of the electricity supplied to the heat generation element flows to the protective layer, an electrochemical reaction may occur between the protective layer and the liquid and the protective layer may become degenerated. When the protective layer is degenerated, the durability of the protective layer may decrease. Furthermore, in a case in which protective layers that each cover a different heat generation element are electrically coupled to each other, the current may flow to the protective layer that is different from the protective layer in which connection with the heat generation element has been established, and the effect of the degeneration may spread inside the liquid discharge head.

In order to prevent such an effect from spreading, a configuration in which the protective layers are individually separated from each other is effective; however, there are liquid discharge heads in which a configuration in which the protective layers are, rather than being separated individually from each other, coupled to each other is favorable. For example, in a case in which cleaning that removes kogation accumulated on the protective layer is performed by leaching the protective layer into the liquid by using an electrochemical reaction, a configuration in which a plurality of protective layers are electrically coupled to each other to apply a voltage to the protective layers is more favorable. Furthermore, in a case in which an occurrence of kogation is suppressed by having particles, which are included in the liquid and that are the cause of kogation, repel the protective layers by applying a potential to the protective layers that repel the potential of the particles, the configuration in which a plurality of protective layers are electrically coupled to each other to apply a voltage to the protective layers if more favorable as well.

Note that Japanese Patent Laid-Open No. 2014-124920 describes a configuration in which a plurality of protective layers are each connected through a corresponding one of fuse portions to common wiring that are electrically coupled to the protective layers. In such a configuration, when current flows into one of the protective layers due to a connection described above being established, the current causes the corresponding fuse portion to be cut; accordingly, electric connection with other protective layers become disconnected as well. With the above, the effect of the degeneration of the protective layer can be suppressed from spreading.

SUMMARY

A liquid discharge head substrate that is an aspect of the present disclosure includes a substrate including a first heat generation element and a second heat generation element that generate heat to discharge a liquid, a first covering portion that covers the first heat generation element and that has conductivity, a second covering portion that covers the second heat generation element and that has conductivity, an insulative layer disposed between the first heat generation element and the first covering portion and between the second heat generation element and the second covering portion, a fuse portion provided on the substrate on a side on which the first covering portion is provided, common wiring for electrically coupling the first covering portion and the second covering portion, the common wiring coupled with the first covering portion via the fuse portion, and a cover layer including at least silicon and carbon and covering the fuse portion.

Further features of the present disclosure will become apparent from the following description of exemplary embodiments with reference to the attached drawings.

DESCRIPTION OF THE EMBODIMENTS

A configuration in which fuse portions are disposed near covering portions that cover heat generation elements is desirable in order to suppress an effect of degeneration of a covering portion from spreading. On the other hand, as in Japanese Patent Laid-Open No. 2014-124920, when the fuse portions are provided at positions in contact with a liquid, the fuse portions may become degenerated with the liquid and the reliability of the fuse portions may decrease.

Accordingly, the present disclosure reduces the possibility of the fuse portions from becoming degenerated by the liquid while suppressing the effect of the degeneration of a covering portion from spreading when a connection is established between the heat generation element and the covering portion.

The present disclosure can reduce the possibility of the fuse portions from becoming degenerated with the liquid while suppressing the effect of the degeneration of a covering portion from spreading when a connection is established between the heat generation element and the covering portion.

Hereinafter, an exemplary embodiment of the present disclosure will be described with reference to the drawings. Note that the following description does not limit the scope of the present disclosure.

While the present embodiment is an ink jet printer (a printer) configured to circulate a liquid, such as ink, between a tank and a liquid discharge apparatus, the present exemplary embodiment may have different configurations. For example, the present embodiment may have a configuration in which the ink inside the pressure chambers is distributed without any circulation of the ink by providing two tanks on the upstream side and the downstream side of the liquid discharge apparatus and distributing the ink from one tank to the other.

While the present embodiment is a liquid discharge apparatus having a so-called line head that has a length corresponding to the width of the printed medium, the present disclosure can be applied to a so-called serial-type liquid discharge apparatus that performs printing while scanning the printed medium. The serial-type liquid discharge apparatus may have a configuration in which a single printing element substrate for black ink and a single printing element substrate for chromatic color ink are mounted, for example. Not limited to the above, a short line head that has a length shorter than the width of the printed medium and that includes a plurality of printing element substrates disposed in a discharge opening column direction so as to overlap the discharge opening may be fabricated, and the short line head may be configured to scan the printed medium.

Ink Jet Printer

Figure 1:
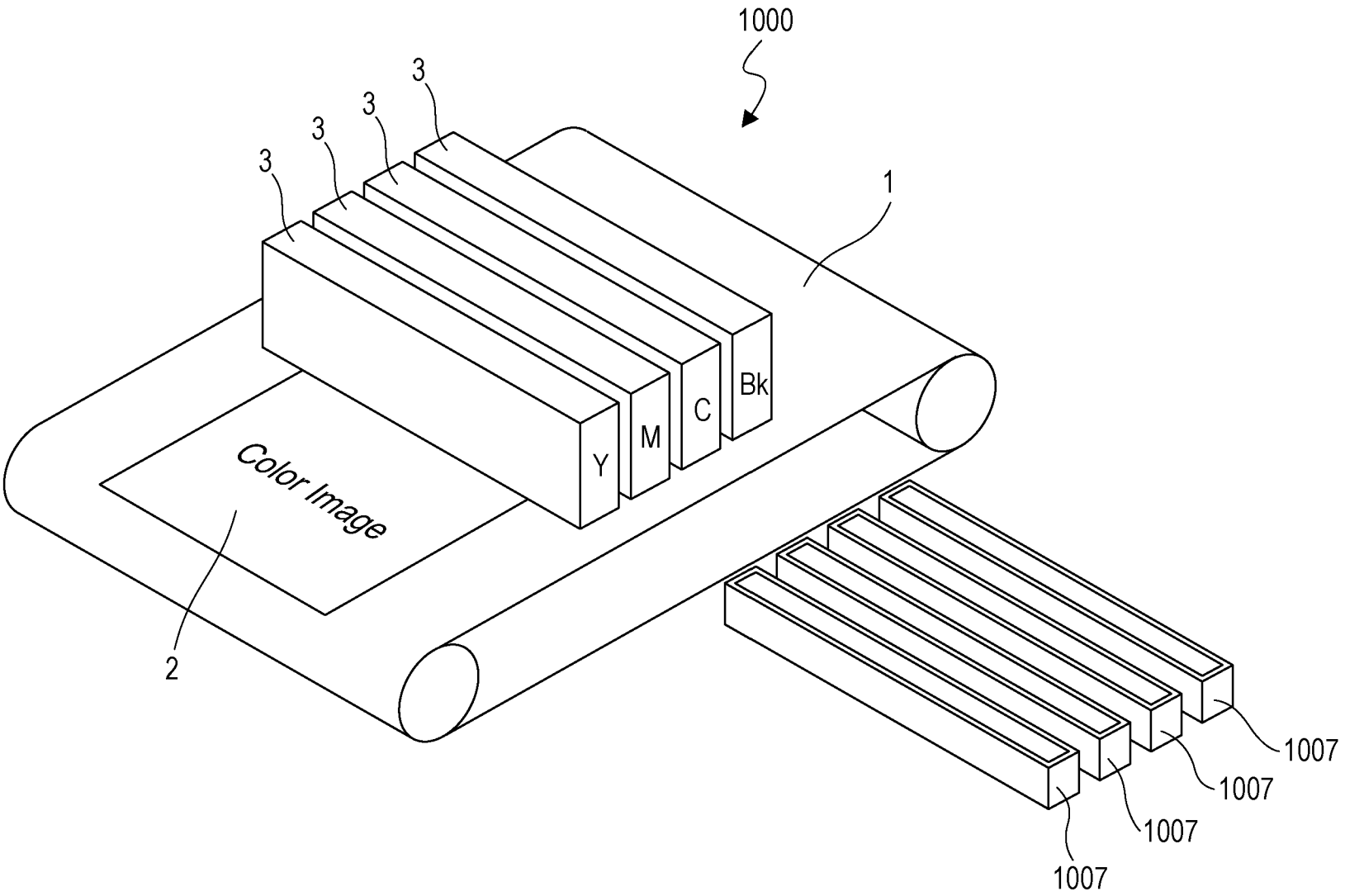
FIG. 1 is a schematic block diagram of a printer.

A schematic configuration of a liquid discharge apparatus of the present embodiment, in particular, an ink jet printer 1000 (hereinafter, also referred to as a printer) that performs printing by discharging ink is illustrated in FIG. 1. The printer 1000 is a line printer that includes a conveying unit 1 that conveys a printed medium 2, and line-type liquid discharge heads 3 disposed substantially orthogonal to a conveying direction of the printed medium, and that performs continuous printing with a single pass while continuously or intermittently conveying a plurality of printed mediums 2. The printed medium 2 is not limited to a cut sheet and maybe a continuous roll sheet. The printer 1000 includes four liquid discharge heads 3 each for a single color corresponding to inks of four colors, namely, CMYK (cyan, magenta, yellow, black). Furthermore, the printer 1000 includes caps 1007. Evaporation of the ink from the discharge openings can be prevented with the caps 1007 covering the discharge opening surface sides of the liquid discharge heads 3 during the non-recording period.

Liquid Discharge Heads

Figure 2A:
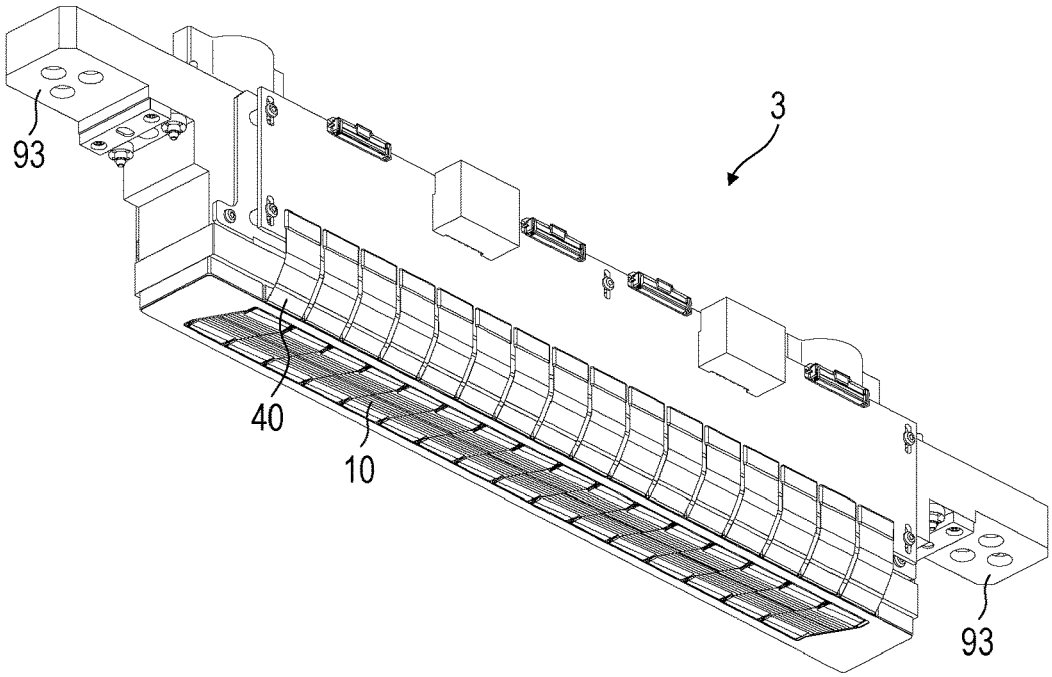
FIGS. 2A and 2B are perspective views of a print head.
Figure 2B:
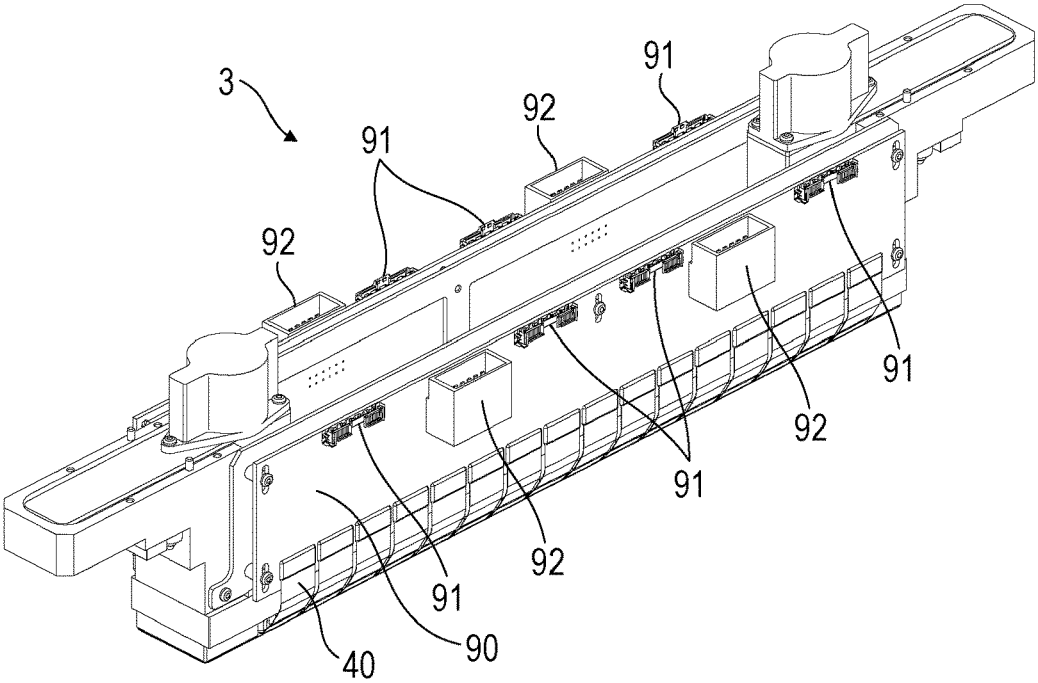

A configuration of the liquid discharge head 3 according to the present embodiment will be described. FIGS. 2A and 2B are perspective views of the liquid discharge head 3 according to the present embodiment. The liquid discharge head 3 is a line-type liquid discharge head in which 16 printing element substrates 10, a single printing element substrate 10 being capable of discharging ink of a single color, are aligned on a straight line (disposed inline). The liquid discharge heads 3 that discharge each of the colors of ink are configured in a similar manner.

As illustrated in FIGS. 2A and 2B, the liquid discharge head 3 includes the printing element substrates 10, flexible wiring substrates 40, and electric wiring substrates 90 provided with signal input terminals 91 and electric power supply terminals 92. The signal input terminals 91 and the electric power supply terminals 92 are electrically coupled to the control unit of the printer 1000 and supply a discharge drive signal and electric power needed for the discharge to the printing element substrates 10. By integrating the wiring with the electric circuits in the electric wiring substrates 90, the number of signal input terminals 91 and the number of electric power supply terminals 92 can be less than the number of printing element substrates 10. With the above, the number of electric connection portions needed to be dismounted can be small when the liquid discharge head 3 is installed in the printer 1000 or when the liquid discharge head is replaced. Connecting portions 93 provided on both end portions of the liquid discharge head 3 are connected to an ink supply system of the printer 1000. Ink is supplied to the liquid discharge head 3 through one of the connecting portions 93 from a supply system of the printer 1000, and the ink that has passed inside the liquid discharge head 3 is collected by the supply system of the printer 1000 through the other connecting portion 93. As described above, the liquid discharge head 3 is configured so that the ink can be circulated through the path of the printer 1000 and the path of the liquid discharge head 3.

Printing Element Substrate

Figure 3:
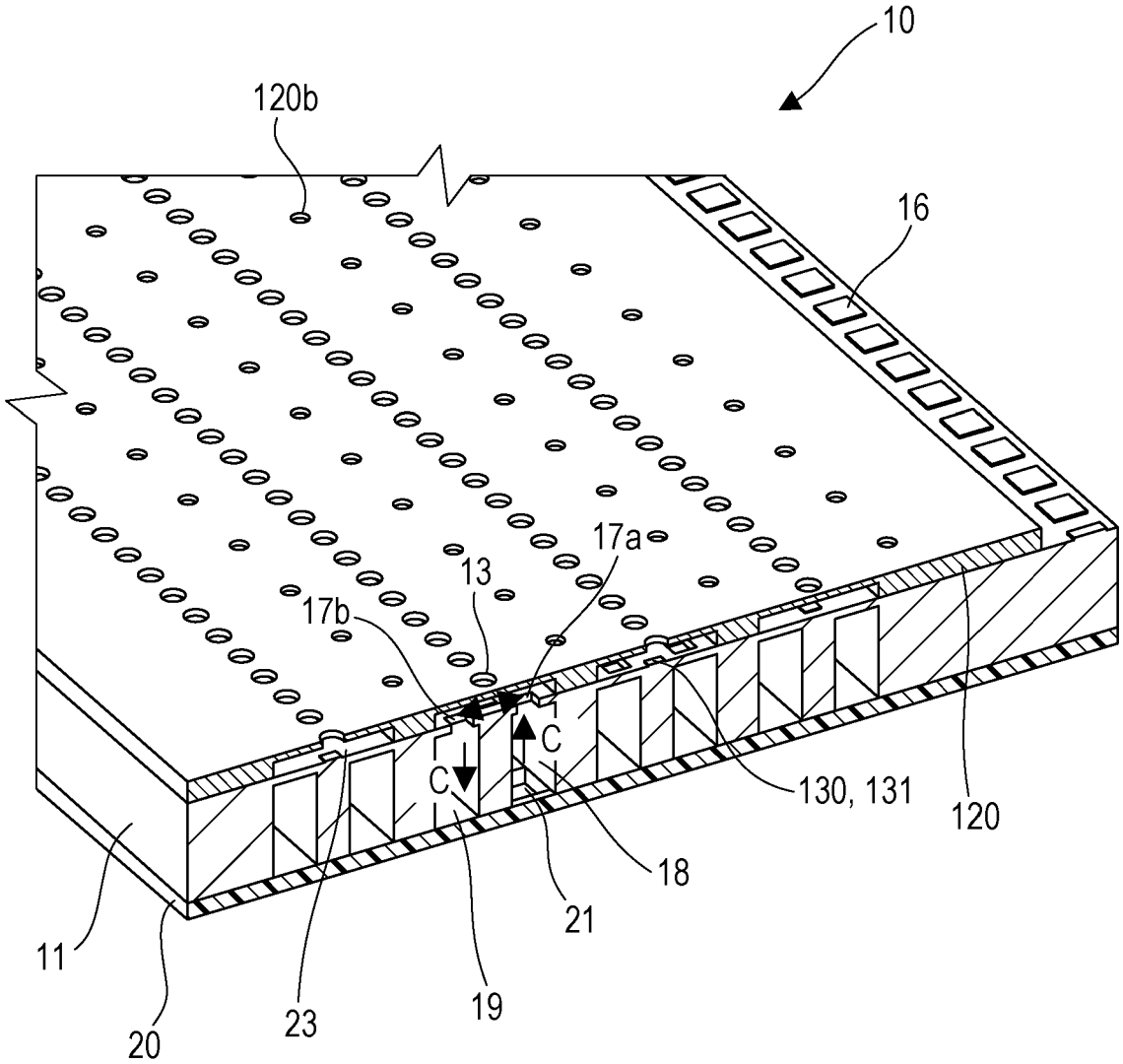
FIG. 3 is a perspective view schematically illustrating a printing element substrate.

FIG. 3 is a perspective view conceptually illustrating the printing element structure (the printing element structure may be also referred to as a liquid discharge head) of the present embodiment.

A substrate 11 (a liquid discharge head substrate) in which liquid supply passages 18 and liquid collection passages 19 are formed, a flow passage forming member 120 situated on the front surface side of the substrate 11, and a cover plate 20 situated on the back surface side of the substrate 11 are formed in the printing element substrate 10. Four lines of discharge opening rows each corresponding to the respective ink color are formed in the flow passage forming member 120 of the printing element substrate 10. The liquid supply passages 18 and the liquid collection passages 19 provided in the substrate 11 extend in the discharge opening column direction. A plurality of supply ports 17*a* in communication with the liquid supply passages 18 and a plurality of collection ports 17*b* in communication with the liquid collection passages 19 are provided in the substrate 11 in the discharge opening column direction.

As illustrated in FIG. 3, heat applying portions 130 that form bubbles in the liquid with heat energy are disposed at positions corresponding to discharge openings 13. The heat applying portions 130 are printing elements that perform printing by discharging a liquid. Furthermore, the heat applying portions 130 are also used as upper electrodes 131 described later. Pressure chambers 23 including therein heat applying portions 130 serving as the printing elements are sectioned with the flow passage forming member 120. Heat generation elements 108 (FIG. 6) provided so as to correspond to the heat applying portions 130 are electrically coupled to terminals 16 through electric wiring (not shown) provided in the substrate 11. Heat is generated based on a pulse signal input through an external wiring substrate (not shown) to boil the liquid inside the pressure chambers 23. With the bubbling force generated by boiling, the liquid is discharged through the discharge openings 13.

Furthermore, openings 21 in communication with the liquid supply passages 18 and openings 21 in communication with the liquid collection passages 19 are provided in the cover plate 20. The ink passing through the opening 21, the liquid supply passage 18, and the supply port 17*a* in that order is supplied to the pressure chamber 23. The ink supplied to the pressure chamber 23 is collected through the collection port 17*b*, the liquid collection passage 19, and the opening 21.

Figure 4A:
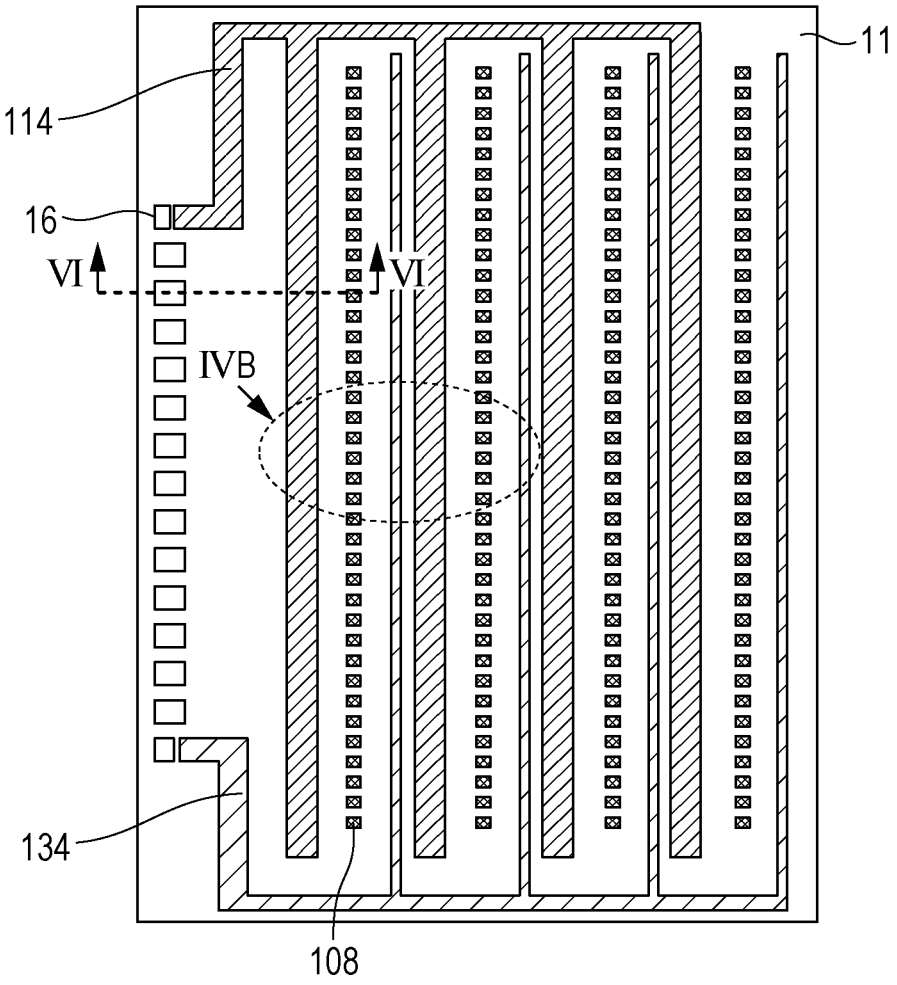
FIGS. 4A and 4B are schematic plan views of the printing element substrate.
Figure 4B:
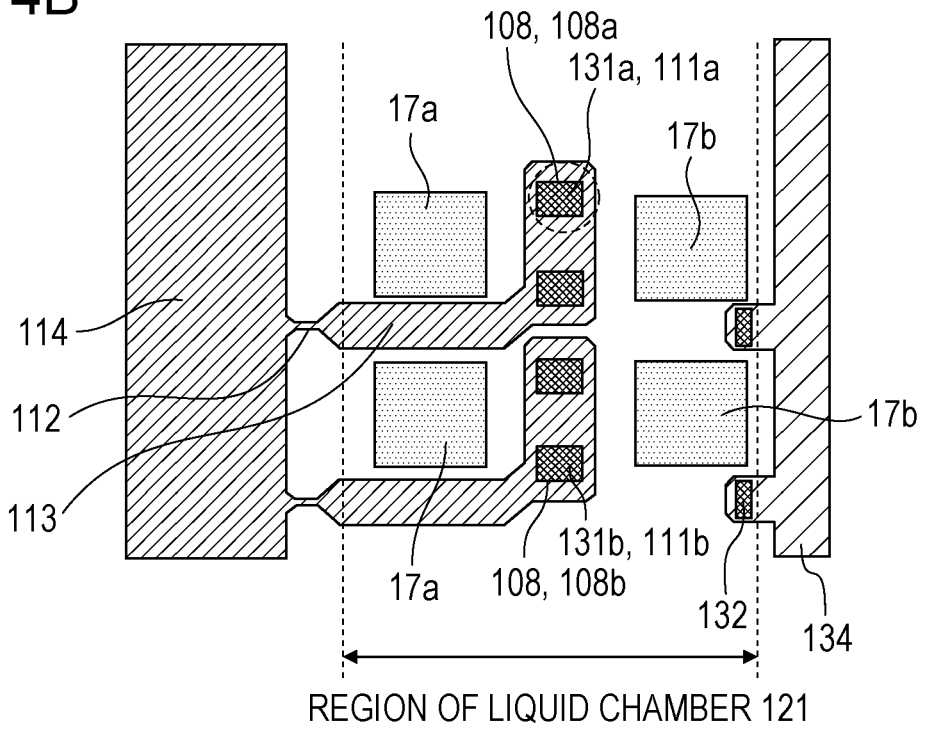

FIGS. 4A and 4B are plan views of the substrate 11 according to the embodiment of the present disclosure. FIG. 4A is a schematic plan view of the substrate 11 according to the embodiment of the present disclosure. Furthermore, FIG. 4B is a schematic plan view of a region IVB indicated by a broken line in FIG. 4A illustrated in an enlarged manner.

Liquid chambers 121 (flow passages) that include the pressure chambers 23 and that are spaces through which the liquid flows are formed between the substrate 11 and the flow passage forming member 120. The upper electrodes 131, which are layered so as to cover the heat generation elements 108, and counter electrodes 132 are disposed inside the liquid chambers 121. The upper electrodes and the counter electrodes are coupled to the terminals 16 through upper electrode common wiring 114 and counter electrode common wiring 134. The terminals 16 are configured so that a potential can be applied to the upper electrodes and the counter electrodes from the outside through the terminals 16 and so that a voltage can be applied between the upper electrodes and the counter electrodes through the liquid (ink) inside the liquid chambers 121. The upper electrodes and the counter electrodes are formed of a conductive material. Note that in pieces of protective layer 111 that protect the heat generation elements 108, portions that include surfaces that are exposed to the liquid function as the upper electrodes 131. Furthermore, the pieces of protective layer 111 may be referred to as covering portions 111 as well.

The upper electrodes 131 are required to function to protect the heat generation elements 108 from physical and chemical impacts and are required to have thermal conductivity that instantaneously transmits the heat generated in the heat generation elements 108 to the ink. The upper electrodes 131 need to be formed of a material that does not form a rigid oxide film when heated to about 700° C. Furthermore, the upper electrodes 131 may be brought to a state in which the potential thereof is relatively lower than those of the counter electrodes 132 during the printing operation so that the upper electrodes 131 function as negative electrodes. With the above, in a case in which negatively charged particles are mainly included in the liquid (ink), the negatively charged particles may be electrically repelled and kept away from the upper electrodes 131 so that adhesion of kogation on the upper electrodes 131 can be suppressed. Furthermore, by having the upper electrodes 131 be brought to a state in which the potential thereof is relatively higher than that of the counter electrodes 132, cleaning that removes the adhered kogation during the printing operation can be performed together with the upper electrodes 131.

A material of such upper electrodes 131 is desirably a simple substance such as iridium (Ir) or ruthenium (Ru), an alloy of Ir and another mental, or an alloy of Ru and another metal. For example, in a case in which the upper electrodes 131 are configured using Ir, by applying a voltage of at least +2.5 V to the upper electrodes 131, the Ir can be leached in the liquid.

In a case in which the negatively charged particles in the ink are kept away from the upper electrodes 131 during the printing operation, the counter electrodes 132 functions as positive electrodes. In order to maintain the electric field formed with the upper electrodes 131 in a stable manner, the counter electrodes 132 are desirably formed of a material that has a low electric conductivity, in which an oxide film is not easily formed, and that includes mental in which leaching does not easily occur by electrochemical reaction.

A material of such counter electrodes 132 is desirably a simple substance such as Ir or Ru, an alloy of Ir and another mental, or an alloy of Ru and another metal. For example, in a case in which the counter electrodes 132 are configured using Ir, a voltage of +2.0 V or smaller is applied to the counter electrodes 132 so that the charged particles are repelled. With the above, an electric field can be formed with the upper electrodes 131 in a stable manner without leaching of the Ir and the charged particles can be kept away from the upper electrodes 131.

As illustrated in FIG. 4A, the plurality of heat generation elements 108 including first heat generation elements 108*a* and second heat generation elements 108*b* are provided in the substrate 11. Furthermore, the substrate 11 is provided with first covering portions 111*a* that cover the first heat generation elements 108*a*, and second covering portions 111*b* that cover the second heat generation elements 108*b*. A plurality of covering portions 111 including the first covering portions 111*a* and the second covering portions 111*b* are electrically coupled to each other through the common wiring 114. In other words, the plurality of upper electrodes 131 are electrically coupled to each other through the common wiring 114. Furthermore, each of the covering portions 111 (the upper electrodes 131) are electrically coupled to the common wiring 114 through individual wires 113 and fuse portions 112 each formed in a portion of a corresponding individual wire 113. A wiring width of each fuse portion 112 is partially narrow. With the above, the current density when the current flows therethrough increases and an increase in temperature due to Joule heat is facilitated; accordingly, each fuse portion 112 can be cut in a stable manner. Note that by having the width of the fuse portion 112 be a few micrometers or less or, preferably, 3 μm or less, the margin for the fuse to be cut is improved. Note that in the present embodiment, as an example, the length of the fuse portion 112 is 10 μm and the width is 2 μm.

As illustrated in FIG. 4B, the substrate 11 is provided with the plurality of supply ports 17*a* (first openings and second openings) that are openings provided in the substrate 11 and that are for supplying the liquid to the heat generation elements 108. Furthermore, each heat generation element 108, the corresponding supply port 17*a*, and the corresponding common wiring 114 are disposed in that order in a direction intersecting a direction in which the plurality of supply ports 17*a* are adjacent to each other. Note that each individual wire 113 is coupled to a corresponding upper electrode 131, passes an area between adjacent supply ports 17*a*, and is coupled to a corresponding common wiring 114 that is provided so as to extend in the discharge opening column direction. The fuse portions 112 are provided on the common wiring 114 side with respect to the area between the supply ports 17*a* and is disposed outside the area of the liquid chambers 121.

Note that in order to suppress the effect from spreading when a connection is established between the heat generation element 108 and the upper electrode 131, desirably, the fuse portion 112 is disposed near the heat generation element 108. Accordingly, in the present embodiment, a distance between the center of gravity of each heat generation element 108 and the center of gravity of the corresponding fuse portion 112 is 130 μm in a direction extending along a plane illustrated in FIG. 4B. In order to suppress the effect from spreading when a connection is established between the heat generation element 108 and the upper electrode 131, it is desirable that the fuse portion 112 is provided so that the distance between the center of gravity of the heat generation element 108 (the discharge opening 13) and the center of gravity of the fuse portion 112 is 150 μm or less.

Figure 4C:
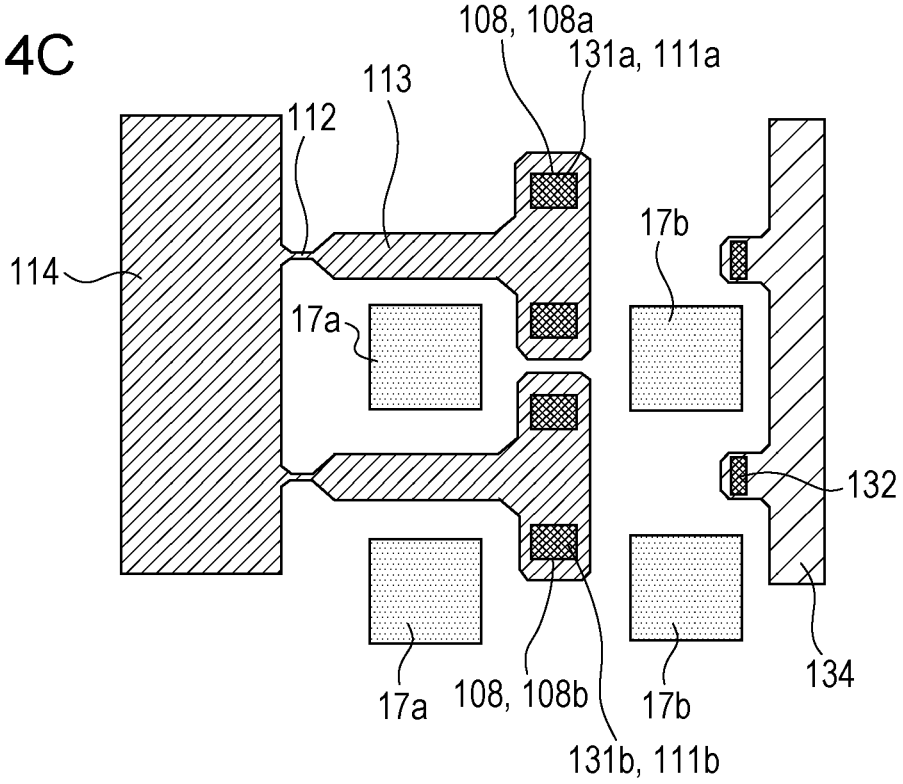
FIG. 4C is view of a modification of the printing element substrate configuration shown in FIG. 4B.

A modification corresponding to FIG. 4B is illustrated in FIG. 4C. The configuration of the modification is different from that in FIG. 4B in that the shapes of the individual wire 113 and the protective layer 111 are different. Specifically, the individual wire 113 that extends from the fuse portion 112 towards the upper side of the heat generation element 108 and the protective layer 111 have a planar shape similar to a T-shape. Compared with the configuration of FIG. 4B, the present configuration is capable of suppressing an increase in wiring resistance between the common wiring 114 and the upper electrode 131.

As described above, in the present embodiment, each fuse portion 112 is disposed at a position near the corresponding liquid chamber 121. With the above, the smallest group including the upper electrode 131 and the heat generation element 108 between which a connection has been established can be separated; accordingly, the effect exerted when the upper electrode 131 and the heat generation element 108 are connected to each other can be prevented from spreading to a larger area and to other heat generation elements.

Note that in the present embodiment, while each of the pieces of protective layer 111 are patterned so as to cover a plurality of heat generation elements 108 (two heat generation elements 108 in the present embodiment), a single protective layer 111 may be configured to cover a single heat generation element 108. Furthermore, in the present embodiment, the fuse portions 112 are provided so that a single fuse portion 112 corresponds to two heat generation elements 108. However, a single fuse portion 112 may be provided for a single heat generation element 108. Furthermore, if the heat generation elements 108 that are not connected to the upper electrode 131 can complement discharge of liquid by the heat generation element 108 that are connected to the upper electrode 131, a single fuse portion 112 can be provided for three or more heat generation elements 108.

Figure 5:
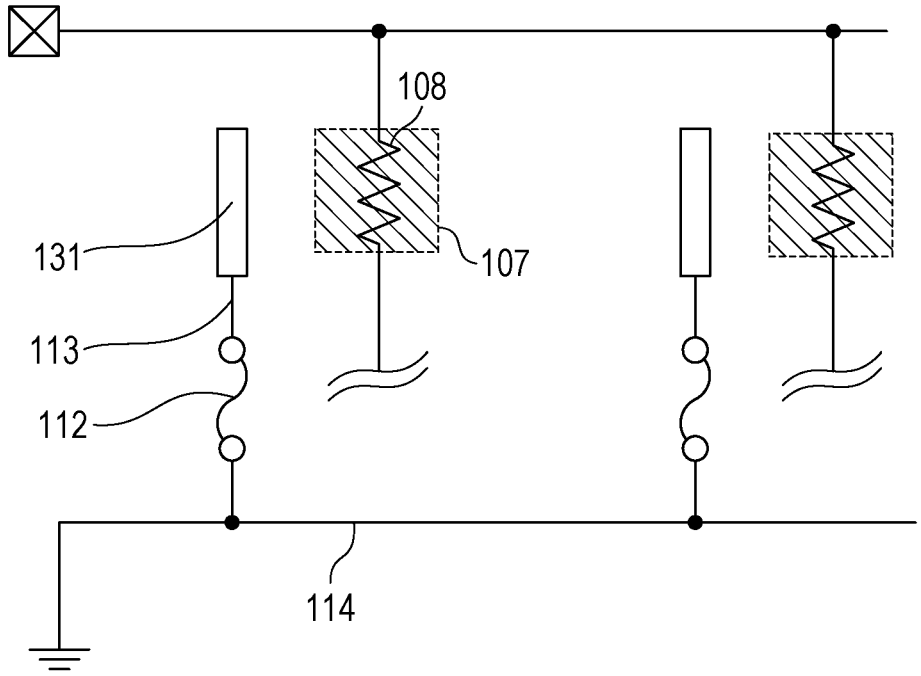
FIG. 5 is a circuit diagram related to an operation of a fuse portion.

FIG. 5 is a circuit diagram related to an operation of the fuse. By having the common wiring 114 coupled to the upper electrode 131 have a voltage of 0 V at all times, when the heat generation element 108 and the upper electrode 131 become connected to each other, a potential difference is created between the two ends of the fuse portion 112 and, accordingly, the fuse portion 112 becomes cut. With the above, the heat generation element 108 that has become connected to the upper electrode 131 can be electrically separated from the common wiring 114.

Note that in a case in which the resistance between the heat generation element 108 and the upper electrode 131 is large, one can assume a case in which the potential applied to the upper electrode 131 will be low and a sufficient current will not flow in the fuse portion 112. In order to cover such a case, a detection unit that detects an establishment of a connection or the effect exerted by the connection may be provided, a mechanism that assists the cutting of the fuse portion 112 by distributing a current to the fuse portion when an establishment of a connection is detected by the detection unit may be provided, or a current may be distributed regularly to the fuse portion 112.

Figure 6:
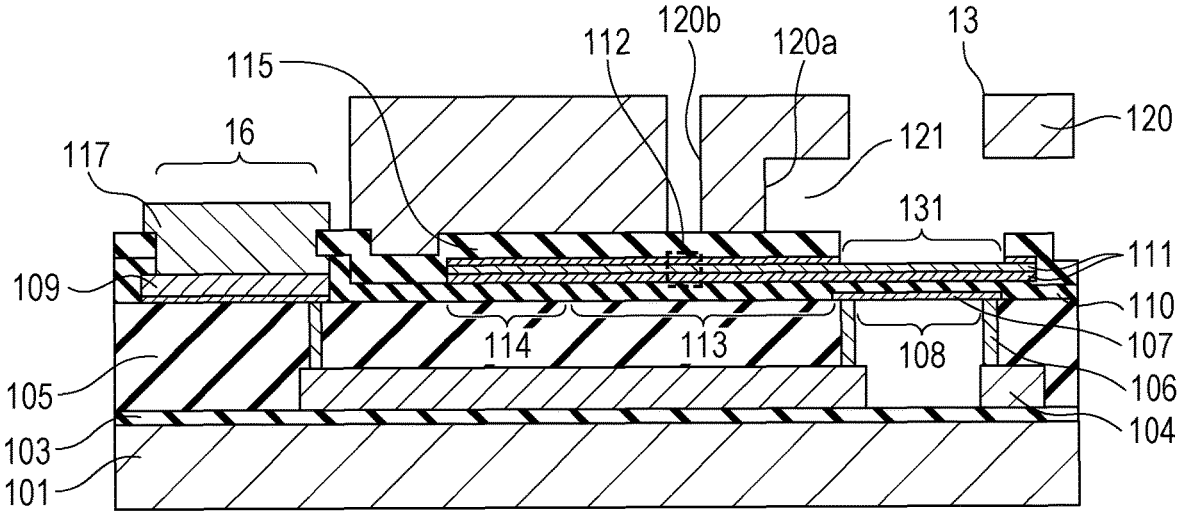
FIG. 6 is a cross-sectional view of the printing element substrate.

FIG. 6 schematically illustrates a layer configuration around the heat generation element 108 and the fuse portion 112. FIG. 6 illustrates a cross-sectional view of the liquid discharge head (the printing element substrate) taken along line VI-VI in which the flow passage forming member 120 is adhered to the substrate 11 in FIG. 4A. For simplicity, illustration or the circuit, the wiring, and the like is omitted; however, the heat generation elements 108 and the fuse portions 112 provided above the substrate 101 are electrically coupled to wiring to obtain electric power needed to generate heat and for the cutting.

While a layer configuration of the liquid discharge head will be described hereinafter, the configuration and the materials described below are merely examples and the present disclosure is not limited to the following description.

An insulative layer 103 formed of SiO or the like is provided on the upper side of the silicon substrate 101 serving as a substrate in which a driving element and wiring for driving the driving element (both not shown) are formed. Furthermore, a wiring pattern 104 formed of an alloy of aluminum and copper is provided on the insulative layer 103. Since the wiring pattern 104 is wiring that supplies a voltage to the heat generation elements 108, the wiring pattern 104 is, desirably, low in resistance. Particularly, the wiring pattern 104 is formed with a thickness of at least 0.5 μm. In the present embodiment, the wiring pattern 104 is formed with a thickness of 1 μm, for example.

The wiring pattern 104 is covered by an insulative layer 105 formed of SiO or the like. Furthermore, plugs 106 that connect the wiring pattern 104 and pieces of heating resistor layer 107 to each other are provided in the insulative layer 105. Tungsten or the like may be used as the material of the plugs 106. A surface of the insulative layer 105 is a surface planarized using a CMP method or the like.

Since the insulative layer 105 is a layer insulating the wiring pattern 104 and the pieces of heating resistor layer 107 from each other, the insulative layer 105 is formed thicker than the wiring pattern 104. Furthermore, the insulative layer 105 formed of SiO that has a high heat accumulation property also functions as a heat accumulating layer and has an effect on the heat dissipation of the heat generation elements 108 and the fuse portions 112. Accordingly, it is desirable that the insulative layer 105 is thick in order to improve the energy efficiency in driving the heat generation elements 108 during discharge of the liquid and to improve sectility of the fuse portions 112. In particular, in order to facilitate the fuse portions 112 to reach the temperature at which the fuse portions 112 are melted and cut, it is desirable that the insulative layer 105 positioned to overlap the fuse portions 112 when the substrate 11 is viewed in plan view is formed with a thickness of at least 1 μm. In the present embodiment, in order to facilitate cutting of the fuse portions 112 while covering the wiring pattern 104, the insulative layer 105 is formed with a thickness of 2 μm, for example.

The pieces of heating resistor layer 107 formed of TaSiN or the like are provided on a surface of the insulative layer 105. A portion in each heating resistor layer 107 where the current flows via the plugs 106 coupled to both ends thereof function as the heat generation element 108. The pieces of heating resistor layer 107 are covered by an insulative layer 110 that is formed of SiN and that has a thickness of 200 nm, for example. The pieces of protective layer 111 serving as the covering portions that cover the heat generation elements 108 are further provided on the above. In the present embodiment, the pieces of protective layer 111 each have, as an example, a two-layered configuration in which tantalum (Ta) of 30 nm and Ir of 60 nm are layered in that order from the insulative layer 110 side. Between the above layers, a portion of each Ir layer in contact with the liquid functions as the upper electrode 131 described above. Furthermore, the Ta layer serves to increase the adhesiveness between the insulative layer 110 and the Ir layer. The heat generation elements 108 and the pieces of protective layer 111 are electrically insulated from each other with the insulative layer 110.

Furthermore, the fuse portions 112, the individual wires 113, and the common wiring 114 are provided above the insulative layer 110. In the present embodiment, the fuse portions 112, the individual wires 113, and the common wiring 114 are formed using the same materials and as a same layer in a layered direction to suppress the process cost. Specifically, the fuse portions 112, the individual wires 113, and the common wiring 114 are configured as a multilayer body of three layers in which, for example, layers of Ta of 30 nm, Ir of 60 nm, and Ta of 70 nm are formed from the insulative layer 110 side. Among the above layers, the two layers on the insulative layer 110 side, namely, the Ta layer and the Ir layer, are formed of layers that are the same as that of the protective layer 111 in the layered direction; accordingly, the process cost is further suppressed.

Furthermore, as described above, the fuse portions 112 are each provided at a region outside the corresponding liquid chamber 121, in other words, the fuse portions 112 are each provided at a position that is away from and, with respect to the corresponding liquid chamber 121, on the opposite side of a wall 120*a*, which forms the corresponding liquid chamber 121 of the flow passage forming member 120 (FIG. 4B).

Note that the fuse portions 112 are covered by pieces of cover layers 115 that are insulative layers having a high liquid resistance property (an ink resistance property). An effect derived from the above configuration will be described.

In a case in which the fuse portion 112 is configured to be in contact with a liquid, degeneration thereof may occur due to the liquid. Note that even in a case in which the fuse portion 112 is provided external to the liquid chamber 121, the liquid may invade to the fuse portion 112 by flowing along the discharge opening surface during printing and during wiping of the discharge opening surface. The above may cause the fuse portion 112 to come in contact with the liquid and to become degenerated. Specifically, in a case in which the fuse portion 112 including Ta is in contact with the liquid, when a positive potential is applied, an electrochemical reaction with the liquid may occur and anodization may occur. Furthermore, when a negative potential is applied to the fuse portion 112, hydrogen may be generated and the fuse portion 112 may occluded the hydrogen, and the materials constituting the fuse portion 112 may become embrittled.

As described above, when the fuse portion 112 becomes degenerated, the function of the fuse portion 112 that, in a case in which a connection is established between the heat generation element 108 and the upper electrode 131, electrically disconnects the upper electrode 131 that has become connected to the heat generation element 108 from the common wiring 114 by cutting the fuse portion 112 may be lost.

Note that the fuse portions 112 function as wiring to apply a potential supplied from the common wiring 114 to the upper electrodes 131 when, as described above, suppressing attachment of kogation to the upper electrodes 131 and removing the kogation attached to the upper electrodes 131. Accordingly, if degeneration occurs in the fuse portions 112, the application of the potential to the upper electrodes 131 may become unstable and it may be difficult to suppress attachment of the kogation and to perform cleaning in a stable manner throughout a long period of time.

Accordingly, by providing the pieces of cover layer 115, which have a high liquid resistant property, on the fuse portions 112 as described above, the possibility of the fuse portions 112 becoming degenerated by the liquid can be suppressed. With the above, the function of the fuse portion 112 that, in a case in which a connection is established between the heat generation element 108 and the upper electrode 131, electrically disconnects the upper electrode 131 that has become connected to the heat generation element 108 from the common wiring 114 by cutting the fuse portion 112 can be maintained. Furthermore, it will be possible to suppress attachment of the kogation and to perform cleaning throughout a long period of time.

Since the individual wires 113 and the common wiring 114 also function as wiring for applying a potential to the upper electrodes 131 when suppressing adhesion of kogation and when performing cleaning, the individual wires 113 and the common wiring 114 may also be covered by the pieces of cover layer 115. Note that in the configuration illustrated in FIG. 6, among the layers constituting the individual wire 113, a lateral edge portion of the Ta layer on the cover layer 115 side and inside the liquid chamber 121 is in contact with the liquid. Even when the lateral edge portion of the Ta layer, which is a thin film of about a few 10 nm, is in contact with the liquid, the effect of the degeneration caused by the liquid is small and the function of the wiring can be maintained for long period of time. Furthermore, since the cover layer 115 and the Ta layer that is in contact with the cover layer 115 can be removed (7G) in the same step with such a configuration, the load of the manufacturing process can be suppressed.

Furthermore, by also having the insulative layer 105 and the insulative layer 110 around the fuse portions 112 be covered by the pieces of cover layer 115, leaching of the insulative layer 105 and the insulative layer 110 into the liquid can be suppressed.

Note that the pieces of cover layer 115 may be formed of any kind of material that has a liquid resistant property (an ink resistance property), and the flow passage forming member 120 that forms the liquid chambers 121 is layered above the individual wires 113 and the common wiring 114. Accordingly, desirably, the pieces of cover layer 115 have a liquid resistant property and, further, are formed of a material that has an excellent adhesiveness with the flow passage forming member 120. For example, in a case in which the flow passage forming member 120 that includes an organic material is used, it is desirable that the pieces of cover layer 115 including at least silicon and carbon, such as SiC or SiCN, that is highly adhesive with the flow passage forming member 120 and that has an excellent liquid resistant property are used. Particularly, in order to protect the fuse portions 112 from the liquid, it is desirable that the thickness of each of the above pieces of cover layer 115 is at least 50 nm. Furthermore, since the cover layer 115 including SiCN has insulation properties that are higher than that of the cover layer 115 formed of SiC, anodization can be suppressed when a connection is established between the heat generation element 108 and the upper electrode 131 and the possibility of the flow passage forming member 120 peeling off is smaller; accordingly, the cover layer 115 that includes SiCN is more desirable. In the present embodiment, the pieces of cover layer 115 are formed using SiCN.

Furthermore, through holes 120*b* may be formed in the flow passage forming member 120 positioned above the fuse portions 112. In other words, the through holes 120*b* may be formed in the flow passage forming member 120 at positions that overlap the fuse portions 112 when viewing the printing element substrate 10 in plan view. With the above, when a connection is established between the heat generation element 108 and the upper electrodes 131, dissipation of heat to the flow passage forming member 120 side can be suppressed compared with a case in which the through holes 120*b* are not formed; accordingly, an increase in temperature or the fuse portion 112 is facilitated and cutting of the fuse portion 112 is facilitated. When such through holes 120*b* are formed, there is a risk of the liquid invading from the discharge opening surface side and being accumulated; however, since the fuse portions 112 are covered by pieces of cover layer 115 that have a high liquid resistant property, the possibility of the fuse portions 112 becoming degenerated by the liquid can be suppressed. Note that regarding the positional relationship between each fuse portion 112 and the corresponding through hole 120*b*, it is only sufficient that at least a portion of each of the fuse portion 112 and the through hole 120*b* overlap each other when the printing element substrate 10 is viewed in plan view. In order to increase the sectility of the fuse portion 112, it is desirable that the fuse portion 112 is provided so that the entire fuse portion 112 is included within the through hole 120*b* when the printing element substrate 10 is viewed in plan view.

Note that compared with a configuration in which the pieces of cover layer 115 and the flow passage forming member 120 are not provided, dissipation of heat is facilitated and the fuse portion 112 is not easily cut in a configuration in which the pieces of cover layer 115 are provided on the fuse portions 112. The thickness of each cover layer 115 is preferably 300 nm or less to suppress the effect of the heat dissipation. Furthermore, the sectility of the fuse portions 112 can be obtained by, as described above, providing the thick insulative layer 105 that is formed of SiO having a high heat accumulation property and that has a thickness of least 1 μm on the substrate 101 side of the fuse portions 112.

Furthermore, the pieces of cover layer 115 may, as in the present embodiment, cover the common wiring 114 and the insulative layer 110. With the above, degeneration of the common wiring 114 and leaching of the insulative layer 110 into the liquid can be suppressed.

Method of Manufacturing Printing Element Substrate

Referring next to FIGS. 7A to 7I, a manufacturing process of the printing element substrate (the liquid discharge head) according to the present embodiment will be described. FIGS. 7A to 7I are diagrams corresponding to the cross-sectional view illustrated in FIG. 6.

Figure 7A:
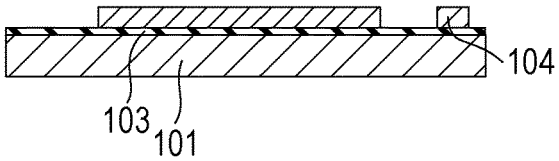
FIGS. 7A to 7I are cross-sectional views illustrating a manufacturing process of the printing element substrate.

The insulative layer 103 is formed first on the upper side of the silicon substrate 101 in which the driving element and the wiring for driving the driving element (both not shown) are formed, and the wiring pattern 104 is formed on the insulative layer 103 (FIG. 7A).

Figure 7B:
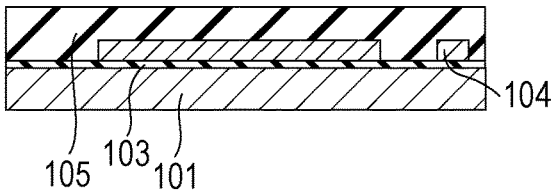

Subsequently, the insulative layer 105 is formed, and the surface of the insulative layer 105 is planarized using the CMP method (FIG. 7B).

Figure 7C:
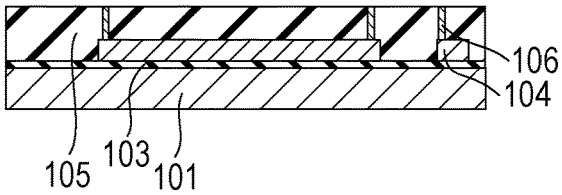

Subsequently, the through holes are formed in the insulative layer 105 and layers of materials for the plugs are formed using a CVD method so as to at least fill the through holes. Furthermore, the plugs 106 are formed by planarizing the surface of the insulative layer 105 using the CMP method (FIG. 7C).

Figure 7D:
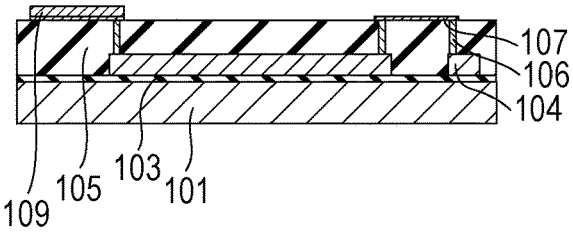

Subsequently, the heating resistor layer 107 and then a metal layer 109 formed of an alloy of aluminum and copper, for example, are formed by sputtering, and the metal layer 109 is patterned. Subsequently, using the metal layer 109 as a mask, the pieces of heating resistor layer 107 are formed by patterning. Subsequently, the portion of the metal layer used as the mask when patterning the pieces of heating resistor layer 107 is removed by wet etching (FIG. 7D).

Figure 7E:
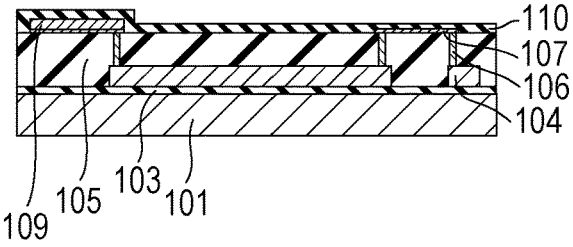

Subsequently, the insulative layer 110 is provided so as to cover the pieces of heating resistor layer 107 and the pieces of metal layer 109 (FIG. 7E).

Figure 7F:
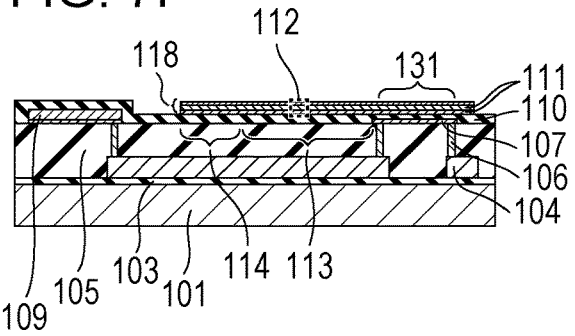

Furthermore, the three layers, that is, the Ta layer, the Ir layer, and the Ta layer are each formed on the above in that order from the insulative layer 110 side by sputtering to form a metal layered film 118, and the metal layered film 118 is patterned. With the above, the upper electrodes 131, the individual wires 113, the fuse portions 112, the common wiring 114, the counter electrodes 132 (FIG. 4B), and the counter electrode common wiring 134 (FIG. 4B) are formed (FIG. 7F).

Figure 7G:
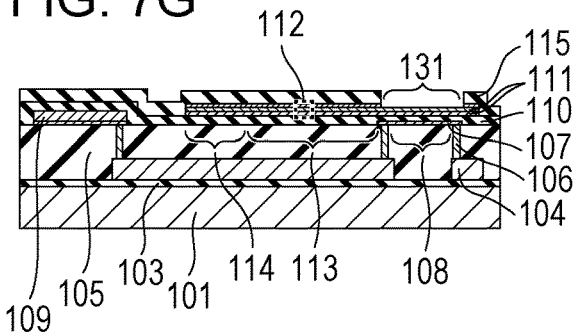

Subsequently, the cover layer 115 formed of SiCN is formed, and the cover layer 115 and the tantalum film, which is on the outermost surface among the metal layered film 118 of three layers, positioned above the upper electrodes 131 and the counter electrodes 132 are removed by dry etching to expose the upper electrodes 131 and the counter electrodes 132 (FIG. 7G).

Figure 7H:
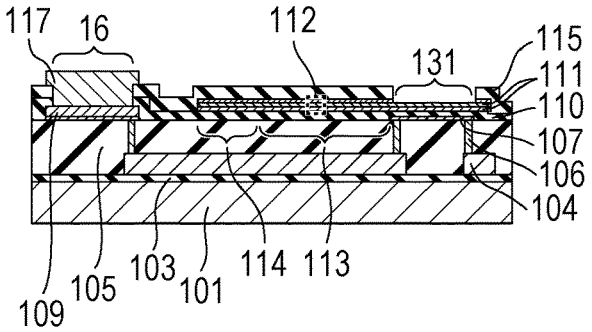

Subsequently, in order to form the terminals 16, openings are formed in the pieces of cover layer 115 and the insulative layer 110 positioned above the pieces of metal layer 109, and pad forming members 117 are formed so that Au is layered on the upper side of the drawing and TiW is layered on the lower side of the drawing, for example, so as to be in communication with the pieces of metal layer 109 (FIG. 7H).

Figure 7I:
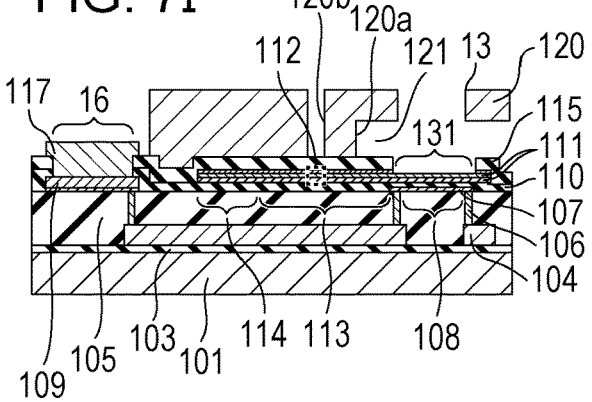

Lastly, as illustrated in FIG. 7I, the flow passage forming member 120 that forms liquid chambers 121 to introduce the liquid to the upper sides of the heat generation elements 108 is fabricated. For example, a photosensitive organic material having a thickness of 5 μm is applied by spin coating, predetermined portions thereof are exposed, and a film of photosensitive organic material 5 μm thick is further formed thereon and is exposed after that. Lastly, the two photosensitive organic materials are simultaneously developed and heat cured so that flow passages having hollow structures are formed.

Furthermore, in a case in which the through holes 120*b* positioned above the fuse portions 112 are formed in the flow passage forming member 120, it is desirable that the through holes 120*b* are formed at the same time as the liquid chambers 121 and the discharge openings 13 are formed since the load of the manufacturing process can be suppressed.

Verification Tests

A plurality of verification tests conducted to verify the effects of the present disclosure will be described next.

The printing element substrates illustrated in FIG. 6 described above were fabricated through the steps illustrated in FIGS. 7A to 7I as the printing element substrates (the liquid discharge heads) of the exemplary embodiment.

Discharge Durability Test

A discharge durability test was conducted by filling cyan pigmented ink in the printing element substrate of the exemplary embodiment. First, in order to suppress kogation by suppressing the particles charged to a negative potential from attaching to the upper electrodes 131, a potential of +1.0 V was applied to the counter electrodes 132 so that the counter electrodes 132 served as positive electrodes and a voltage was applied between the upper electrodes 131 and the counter electrodes 132. In the above state, a potential to perform discharging was applied to the heat generation elements 108 so that the printing element substrate performed a discharge operation (10^9) times.

After the above, deposition of kogation was observed on the surfaces of the upper electrodes 131 when the state of the surface was observed after replacing the insides of the liquid chambers 121 with clear ink. Thereupon, cyan pigmented ink was filled once more and a potential of +5.0 V was applied to the upper electrodes 131 so that the upper electrodes 131 side served as positive electrodes and a voltage was applied between the upper electrodes 131 and the counter electrodes 132 to perform a cleaning process. In so doing, the process was performed while repeatedly switching the polarities between the upper electrodes 131 and the counter electrodes 132 to prevent solidification of the ink.

Subsequently, using the same printing element substrate, five cycles of the discharge operation and the cleaning process were conducted, in which a single cycle conducts the discharge operation (10^9) times and the cleaning process one time.

An output image of a satisfactory quality was confirmed when a normal printing operation according to image data was performed after completing the five cycles.

When an observation was conducted once again after replacing the inside of the liquid chambers 121 with clear ink, no floating of the flow passage forming member 120 from the substrate 11 and no discoloration and cracks in the individual wires 113 were observed. Furthermore, when the portions around the fuse portions 112 were observed, it was found that the pieces of cover layer 115 formed of SiCN covered the portions around the fuse portions without being floated up or peeled and that the fuse portions maintained a state similar to the initial state.

Cut Experiment of Fuse Portion Using TEG Configuration

A relationship between the thickness of the SiO film on the lower side of the fuse portions 112, in other words, the film on the substrate 101 side, and the value of the current capable of cutting the fuse portions 112 was verified using a TEG configuration.

As Sample 1, SiO having a thickness of 2 μm was formed by PECVD on a substrate in which SiO having a thickness of 100 nm was formed on a silicon substrate, and a SiN film having a thickness of 200 nm was formed after the above. The layered film was formed on the above by sequentially sputtering 30 nm of Ta, 60 nm of Ir, and 70 nm of Ta. Furthermore, the layered film was coated by SiCN having a thickness of 150 nm. Furthermore, patterning to form fuse portions and pads for applying a voltage to the fuse portions was performed with the layer film of Ta/Ir/Ta and Sample 1 was fabricated.

As Sample 2, a TEG was fabricated in which the SiO of a thickness of 2 μm in Sample 1 formed by PECVD was formed with a thickness of 1 μm. Other configurations thereof were similar to those of the configurations of Sample 1.

As Sample 3, a TEG that has a configuration that is similar to that of Sample 1 but that is not provided with a 2 μm-thick SiO in Sample 1 formed by PECVD was fabricated. In other words, Sample 3 has a configuration in which SiO having a thickness of 100 nm is formed on the silicon substrate side of the fuse portions 112.

Cutting characteristics of the fuse portions of Samples 1 to 3 were investigated by changing the voltage value applied to both ends of the fuse portions using a power supply. In Sample 1, the fuse portions were cut when a current of about 50 mA flowed through the fuse portions. In Sample 2, the fuse portions were cut when a current of about 60 mA flowed through the fuse portions. In Sample 3, the fuse portions were not cut by a current of about 60 mA and was cut when the current value flowing through the fuse portions was about 100 mA. Through the sectility of the fuse portions, it has been found that the SiO preferably has a thickness of at least 1 μm.

Disconnection Test

Using the printing element substrate of the exemplary embodiment used in the discharge durability test, a disconnection was intentionally created in a selected heat generation element 108 by applying a pulse voltage that is five times the voltage during ordinary discharge. The fuse portion 112 on the disconnected heat generation element 108 and connected to the upper electrode 131 was melted and cut. By conducting an electrical inspection, it was confirmed that the upper electrode 131 on the disconnected heat generation element 108 was electrically separated from the other heat generation elements 108.

A stable discharge operation was capable of being maintained when ordinary printing was performed after the above with the other heat generation elements 108.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-030192 filed Feb. 22, 2018 and No. 2019-003805 filed Jan. 11, 2019, which are hereby incorporated by reference herein in their entirety.

What is claimed is:

1. A liquid discharge head substrate comprising:

a substrate including a first heat generation element and a second heat generation element that generate heat to discharge a liquid;

a first covering portion that covers the first heat generation element and that has conductivity;

a second covering portion that covers the second heat generation element and that has conductivity;

an insulative layer disposed between the first heat generation element and the first covering portion and between the second heat generation element and the second covering portion;

a fuse portion provided on the substrate on a side on which the first covering portion is provided;

common wiring for electrically coupling the first covering portion and the second covering portion, the common wiring coupled with the first covering portion via the fuse portion; and a cover layer including at least silicon and carbon and covering the fuse portion.

2. The liquid discharge head substrate according to claim 1, wherein the cover layer includes SiCN (silicon carbonitride).

3. The liquid discharge head substrate according to claim 1, wherein when the liquid discharge head substrate is viewed in plan view, the substrate includes a layer that includes SiO (silicon oxide) having a thickness of at least 1 μm at a position that overlaps the fuse portion.

4. The liquid discharge head substrate according to claim 1, wherein the fuse portion includes tantalum.

5. The liquid discharge head substrate according to claim 1, wherein the common wiring and the fuse portion are provided as a same layer in a layered direction in the liquid discharge head substrate, and wherein the cover layer covers the common wiring.

6. The liquid discharge head substrate according to claim 1, wherein the common wiring includes tantalum.

7. The liquid discharge head substrate according to claim 1, wherein a surface of the first covering portion on a side opposite to a surface thereof on a first heat generation element side includes a layer including iridium.

8. The liquid discharge head substrate according to claim 7, wherein the fuse portion includes a multilayer body in which a layer including iridium and a layer including tantalum are layered in that order from a substrate side, and wherein the layer of the fuse portion including the iridium and the layer of the first covering portion including the iridium are configured as a same layer in a layered direction in the liquid discharge head substrate.

9. The liquid discharge head substrate according to claim 1, further comprising:

an individual wire that electrically couples the first covering portion and the fuse portion to each other and that is provided as a layer that is the same as that of the fuse portion in a layered direction in the liquid discharge head substrate; and a first opening and a second opening provided adjacent to each other, the first opening and the second opening having the liquid flow therethrough, wherein when the liquid discharge head substrate is viewed in plan view, the first heat generation element, the first opening, and the common wiring are disposed in that order in a direction intersecting a direction in which the first opening and the second opening are adjacent to each other, and wherein the individual wire is disposed through a region passing between the first opening and the second opening, and the fuse portion is positioned on a common wiring side with respect to the region.

10. The liquid discharge head substrate according to claim 1, wherein a potential is applicable to the first covering portion through the common wiring and the fuse portion.

11. The liquid discharge head substrate according to claim 1, wherein when the liquid discharge head substrate is viewed in plan view, a distance between a center of gravity of the fuse portion and a center of gravity of the first heat generation element is 150 μm or less.

12. A liquid discharge head comprising:

a liquid discharge head substrate including:

a substrate including a first heat generation element and a second heat generation element that generate heat to discharge a liquid;

a first covering portion that covers the first heat generation element and that has conductivity;

a second covering portion that covers the second heat generation element and that has conductivity;

an insulative layer disposed between the first heat generation element and the first covering portion and between the second heat generation element and the second covering portion;

a fuse portion provided on the substrate on a side on which the first covering portion is provided;

common wiring for electrically coupling the first covering portion and the second covering portion, the common wiring coupled with the first covering portion via the fuse portion; and a cover layer including at least silicon and carbon and covering the fuse portion; and a flow passage forming member that is provided on a first covering portion side of the liquid discharge head substrate, the flow passage forming member including a wall that forms a flow passage.

13. The liquid discharge head according to claim 12, wherein the cover layer includes SiCN (silicon carbonitride).

14. The liquid discharge head according to claim 12, wherein the fuse portion includes tantalum.

15. The liquid discharge head according to claim 12, wherein the fuse portion is provided on a side opposite to a side of a surface of the wall forming the flow passage and at a position distanced away from the wall.

16. The liquid discharge head according to claim 12, wherein when the liquid discharge head substrate is viewed in plan view, the flow passage forming member includes a through hole at a position overlapping at least a portion of the fuse portion, and wherein the cover layer includes a surface exposed from the through hole.

17. The liquid discharge head according to claim 12, wherein a potential is applicable to the first covering portion through the common wiring and the fuse portion.

* * * * *